US005256624A

United States Patent [19]

Etzbach et al.

[11] Patent Number: 5,256,624

[45] Date of Patent: Oct. 26, 1993

[54] TRANSFER OF METHINE DYES

[75] Inventors: Karl-Heinz Etzbach, Frankenthal; Ruediger Sens, Mannheim, both of Fed. Rep. of Germany

[73] Assignee: BASF Aktiengesellschaft, Ludwigshafen, Fed. Rep. of Germany

[21] Appl. No.: 860,156

[22] Filed: Mar. 30, 1992

[30] Foreign Application Priority Data

Apr. 18, 1991 [DE] Fed. Rep. of Germany ..... 4112654

[51] Int. Cl.[5] ..... B41M 5/035; B41M 5/38

[52] U.S. Cl. ..... 503/227; 428/195; 428/913; 428/914

[58] Field of Search ..... 8/471; 428/195, 93, 428/914; 503/227

[56] References Cited

U.S. PATENT DOCUMENTS

| | | | |
|---|---|---|---|
| 4,698,651 | 10/1987 | Moore et al. | 503/227 |
| 5,079,365 | 1/1992 | Sens et al. | 346/119 |

FOREIGN PATENT DOCUMENTS

| | | |
|---|---|---|
| 0209990 | 1/1987 | European Pat. Off. . |
| 0258856 | 3/1988 | European Pat. Off. . |
| 0279467 | 8/1988 | European Pat. Off. . |
| 0312211 | 4/1989 | European Pat. Off. . |
| 0346729 | 12/1989 | European Pat. Off. . |
| 0216483 | 4/1990 | European Pat. Off. . |
| 0416434 | 3/1991 | European Pat. Off. . |
| 0427867 | 5/1991 | European Pat. Off. . |
| 0441208 | 8/1991 | European Pat. Off. . |
| 0441282 | 8/1991 | European Pat. Off. . |
| 0444327 | 9/1991 | European Pat. Off. . |
| 0460463 | 12/1991 | European Pat. Off. . |
| 60-229786 | 4/1985 | Japan . |
| 284390 | 7/1990 | Japan . |
| 232164 | 8/1990 | Japan . |

OTHER PUBLICATIONS

World Patents Index Latest Week 9103, Derwent Publications Ltd., London, GB; AN 91-019242 & JP-A-2 292 371 (Sankyo Kagaku KK) 3, Dec. 1990 *Zusammenfassung*.

Chemical Abstracts, vol. 112, No. 1, 1, Jan. 1990, Columbus, Ohio, US; Abstract No. 6938Q, H. Mustroph et al. 'Different substituent effects on the absorption maxima of azomethines and hydrazones,' Seite 682; Spalte Recht; *Zusammenfassung*.

World Patent Index Latest Week 9011, Derwent Publications, Ltd., London, GB. AN 90-079267*Zusammenfassung* & Patent Abstracts of Japan, vol. 14, No. 188 (C-710)17, Apr. 1990 & JP-A-2 032 164 (Sumitomo Chem Ind KK) 1. Feb. 1990 *Zusammenfassung*.

Patent Abstracts of Japan vol. 11 No. 262 (C-442) (2709) 25, Aug. 1987 & JP-A-62 062 866 (Mitsui Toatsu Chem Inc) 19, Mar. 1987 *Zusammenfassung*.

Patent Abstracts of Japan vol. 15, No. 65 (M-1082) 15, Feb. 1991 & JP-A-2 292 090 (Dai Nippon Printing Co Ltd) 3, Dec. 1990 *Zusammenfassung* & EP-A-0 427 867 *Tabelle Al, Verbindungen 29,32 *Tabelle D2*.

*Primary Examiner*—B. Hamilton Hess

*Attorney, Agent, or Firm*—Oblon, Spivak, McClelland, Maier & Neustadt

[57] ABSTRACT

A process for transferring methine dyes from a transfer to plastic-coated paper by diffusion with the aid of an energy source comprises using a transfer on which there is or are located one or more dyes of the formula

K—N=B where

K is an aromatic carboxylic or heterocyclic radical and

B is the radical of an acidic CH compound.

4 Claims, No Drawings

TRANSFER OF METHINE DYES

The present invention relates to a novel process for transferring methine dyes from a transfer to plastic-coated paper with the aid of an energy source.

In the thermal transfer printing process, a transfer sheet, which contains a thermally transferable dye in one or more binders with or without suitable assistants, on a substrate, is heated from the back with an energy source, for example a thermal head or a laser, in the form of short heating pulses (duration: fractions of a second), causing the dye to migrate out of the transfer sheet and diffuse into the surface coating of a receiving medium. The essential advantage of this process is that the amount of dye to be transferred, and hence the color gradation, is readily controlled by setting the energy to be emitted by the energy source.

In general, color recording involves the use of the three subtractive primaries yellow, magenta and cyan (with or without black).

To permit optimal color recording, the dyes must have the following properties:

- ready thermal transferability,
- minimal tendency to migrate within or out of the surface coating of the receiving medium at room temperature,
- high thermal and photochemical stability and resistance to moisture and chemicals,
- suitable hues for subtractive color mixing,
- a high molar absorption coefficient, and
- no tendency to crystallize out on storage of the transfer sheet.

It is known from experience that it is very difficult to meet all these requirements at one and the same time.

For this reason most of the dyes used for thermal transfer printing, in particular those which have the color of the primary magenta, do not meet the required property profile.

For instance, JP-A-229 786/1985, JP-A-84 390/1990 and EP-A-258 856 describe aniline derivatives which have a tricyanovinyl radical para to the amino group for this purpose. JP-A-32 164/1990 describes dyes which contain 4-nitrophenylacetonitrile as acidic CH component.

However, it has been found that these dyes do not give adequate results.

It is an object of the present invention to provide a novel process for transferring methine dyes which absorb within the bluish green or green region of the spectrum and which shall have the properties mentioned at the beginning.

We have found that this object is achieved by a process for transferring a methine dye from a transfer to plastic-coated paper by diffusion with the aid of an energy source, which comprises using a transfer on which there is or are located one or more dyes of the formula I $$K—N=B$$

where

K is an aromatic carbocyclic or heterocyclic radical and

B is the radical of an acidic CH compound which is derived from nitromethane, nitroethane, benzimidazolen-2-ylacetamide or a compound of the formula

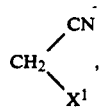
(IIa)

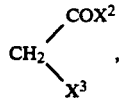
(IIb)

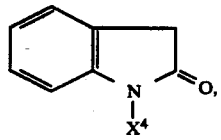
(IIc)

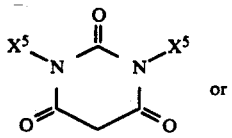
(IId)

or

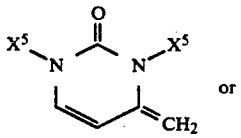
(IIe)

where $X^1$ is cyano, nitro, $C_1$–$C_4$-alkanoyl, unsubstituted or $C_1$–$C_4$-alkyl-, $C_1$–$C_4$-alkoxy- or halogen-substituted benzoyl, $C_1$–$C_4$-alkylsulfonyl, unsubstituted or $C_1$–$C_4$-alkyl-, $C_1$–$C_4$-alkoxy- or halogen-substituted phenylsulfonyl, carboxy, $C_1$–$C_6$-alkoxycarbonyl, monooxa- or dioxa-$C_1$–$C_6$-alkoxycarbonyl, $C_5$–$C_7$-cycloalkoxycarbonyl, unsubstituted or $C_1$–$C_4$-alkyl-, $C_1$–$C_4$-alkoxy- or halogen-substituted phenoxycarbonyl, carbamoyl, mono- or di-$C_1$–$C_6$-alkylcarbamoyl, monooxa- or dioxa-mono-or -di-$C_1$–$C_6$ -alkylcarbamoyl, mono- or di-$C_5$–$C_7$-cycloalkylcarbamoyl, unsubstituted or $C_1$–$C_4$-alkyl-, $C_1$–$C_4$-alkoxy- or halogen-substituted phenylcarbamoyl, unsubstituted or $C_1$–$C_4$-alkyl-, cyano-, $C_1$–$C_4$-alkoxy-, halogen- or nitro-substituted phenyl, 2-benzothiazolyl, 2-benzimidazolyl, 5-phenyl-1,3,4-thiadiazol-2-yl or 2-hydroxyquinoxalin-3-yl, $X^2$ is $C_1$–$C_4$-alkyl or $C_1$–$C_4$-alkoxy, $X^3$ is $C_1$–$C_4$-alkoxycarbonyl, phenylcarbamoyl or 2-benzimidazolyl, $X^4$ is $C_1$–$C_4$-alkyl, and $X^5$ is hydrogen, $C_1$–$C_4$-alkyl or phenyl.

Aromatic carbocyclic or heterocyclic radicals K are derived for example from the aniline, aminonaphthalene, indole, quinoline, benzoxazine, aminothiazole, diaminopyridine, aminothiophene, benzimidazole or benzothiazole series.

Preference is given to a process where there is or are located on the transfer one or more dyes of the formula I where K is a radical of the formula (IIIa)
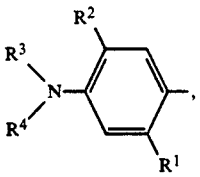
(IIIb)
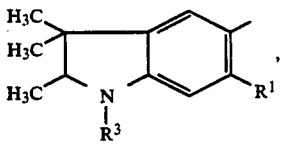
(IIIc)
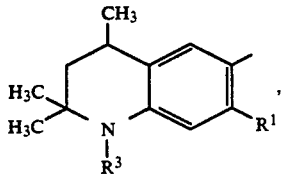
(IIId)
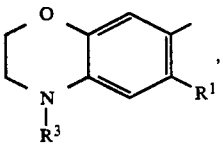
(IIIe)
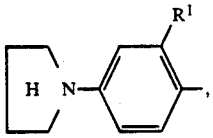
(IIIf)
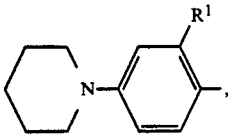
(IIIg)
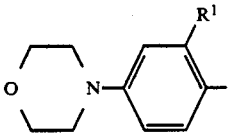
(IIIh)
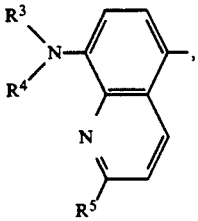
(IIIi)
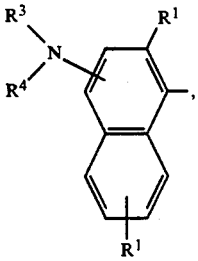
-continued
(IIIj)
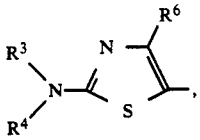
(IIIk)
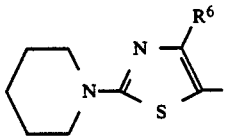
(IIIl)
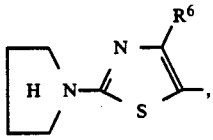
(IIIm)
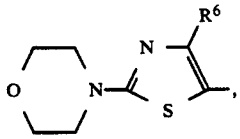
(IIIn)
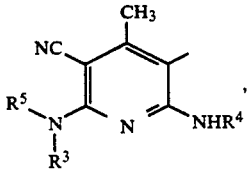
(IIIo)
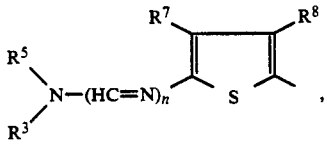
(IIIp)
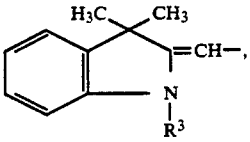
(IIIq)
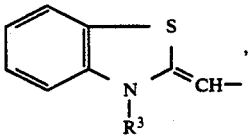
(IIIr)
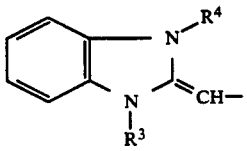
or
(IIIs)
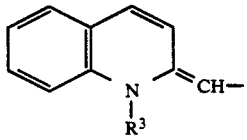
where
n is 0 or 1, $R^1$ is hydrogen, methyl, methoxy, mono- or di-$C_1$–$C_4$-alkylaminosulfonylamino, $C_1$–$C_4$-alkylsulfonylamino or the radical —$NHCOR^9$ or —$NHCO_2R^9$, where $R^9$ is phenyl benzyl, tolyl or $C_1$–$C_8$-alkyl which may be interrupted by one or two oxygen atoms in ether function, $R^2$ is hydrogen, methyl, methoxy or ethoxy, $R^3$ and $R^4$ are identical or different and each is independently of the other hydrogen, $C_1$–$C_8$-alkyl, which may be substituted and which may be interrupted by one or two oxygen atoms in ether function, or $C_5$–$C_7$-cycloalkyl, $R^5$ is $C_1$–$C_8$ -alkyl, which may be substituted and which may be interrupted by one or two oxygen atoms in ether function, $C_5$–$C_7$-cycloalkyl, phenyl or tolyl, $R^6$ is hydrogen, halogen, $C_1$–$C_6$-alkyl, unsubstituted or $C_1$–$C_4$-alkyl- or $C_1$–$C_4$-alkoxy-substituted phenyl, unsubstituted or $C_1$–$C_4$-alkyl- or $C_1$–$C_4$-alkoxy-substituted benzyl, cyclohexyl, thienyl, hydroxyl or $C_1$–$C_8$-monoalkylamino, $R^7$ is cyano, carbamoyl, mono- or di-$C_1$–$C_6$-alkylcarbamoyl or $C_1$–$C_6$-alkoxycarbonyl, and $R^8$ is halogen, hydrogen, $C_1$–$C_4$-alkyl, $C_1$–$C_4$-alkoxy, $C_1$–$C_4$-alkylthio or unsubstituted or $C_1$–$C_4$-alkyl-substituted phenyl.

Any alkyl appearing in the abovementioned formulae may be either straight-chain or branched.

Any substituted alkyl or phenyl appearing in the abovementioned formulae is in general monosubstituted, disubstituted or trisubstituted.

Any substituted alkyl appearing in the abovementioned formulae may have as substituents for example cyano, phenyl, tolyl, $C_1$–$C_4$-alkanoyloxy, $C_1$–$C_4$-alkoxycarbonyl or $C_1$–$C_4$-alkoxycarbonyloxy, the last mentioned of which may in turn be substituted in the alkoxy group by phenyl, tolyl or $C_1$–$C_4$-alkoxy.

Suitable $X^2$, $X^4$, $X^5$, $R^3$, $R^4$, $R^5$ and $R^8$ is in each case for example methyl, ethyl, propyl, isopropyl, butyl, isobutyl or sec-butyl.

$R^3$, $R^4$ and $R^6$ may each also be f or example pentyl, isopentyl, neopentyl, tert-pentyl, hexyl or 2-methylpentyl.

$R^3$ and $R^4$ may each also be for example heptyl, octyl, 2-ethylhexyl, 2-methoxyethyl, 2- or 3-methoxypropyl, 2-ethoxyethyl, 2- or 3-ethoxypropyl, 2-propoxyethyl, 2- or 3-propoxypropyl, 2-butoxyethyl, 2- or 3-butoxypropyl, 3,6-dioxaheptyl, 3,6-dioxaoctyl, 2-cyanoethyl, 2- or 3-cyanopropyl, 2-acetyloxyethyl, 2- or 3-acetyloxypropyl, 2-isobutyryloxyethyl, 2- or 2-isobutyryloxypropyl, 2-methoxycarbonylethyl, 2- or 3-methoxycarbonylpropyl, 2-ethoxycarbonylethyl, 2- or 3-ethoxycarbonylpropyl, 2-methoxycarbonyloxyethyl, 2- or 3-methoxycarbonyloxypropyl, 2-ethoxycarbonyloxyethyl, 2- or 3-ethoxycarbonyloxypropyl, 2-butoxycarbonyloxyethyl, 2- or 3-butoxycarbonyloxypropyl, 2-(2-phenylethoxycarbonyloxy)ethyl, 2- or 3-(2-phenylethoxycarbonyloxy)propyl, 2-(2-ethoxyethoxycarbonyloxy)ethyl, 2- or 3-(2-ethoxyethoxycarbonyloxy)propyl, benzyl, 2-methylbenzyl, 1- or 2-phenylethyl, cyclopentyl, cyclohexyl or cycloheptyl.

$X^2$ and $R^8$ may each also be for example methoxy, ethoxy, propoxy, isopropoxy, butoxy, sec-butoxy, methylthio, ethylthio, propylthio, isopropylthio or butylthio.

$R^8$ may also be for example fluorine, chlorine or bromine.

$R^1$ is for example methylsulfonylamino, ethylsulfonylamino, propylsulfonylamino, isopropylsulfonylamino, butylsulfonylamino, mono- or dimethylaminosulfonylamino, mono- or diethylaminosulfonylamino, mono- or dipropylaminosulfonylamino, mono- or diisopropylaminosulfonylamino, mono- or dibutylaminosulfonylamino or (N-methyl-N-ethylaminosulfonyl)amino.

$X^1$, $X^3$ and $R^7$ are each for example methoxycarbonyl, ethoxycarbonyl, propoxycarbonyl, isopropoxycarbonyl or butoxycarbonyl.

$X^1$ and $R^7$ may each also be for example pentyloxycarbonyl, hexyloxycarbonyl, mono- or dimethylcarbamoyl, mono- or diethylcarbamoyl, mono- or dipropylcarbamoyl, mono- or diisopropylcarbamoyl, mono- or dibutylcarbamoyl or N-methyl-N-ethylcarbamoyl.

$X^1$ may also be for example 2-methoxyethoxycarbonyl, 2-ethoxyethoxycarbonyl, 3,6-dioxaheptyloxycarbonyl, cyclopentyloxycarbonyl, cyclohexyloxycarbonyl, cycloheptyloxycarbonyl, formyl, acetyl, propionyl, butyryl, isobutyryl, benzoyl, 2-methylbenzoyl, 2,4-dimethylbenzoyl, 2-methoxybenzoyl, 2,4-dimethoxybenzoyl, 2-chlorobenzoyl, 2,4-dichlorobenzoyl, methylsulfonyl, ethylsulfonyl, propylsulfonyl, isopropylsulfonyl, butylsulfonyl, phenylsulfonyl, 2- or 4-methylphenylsulfonyl, mono- or dipentylcarbamoyl, mono- or dihexylcarbamoyl, mono- or bis(2-methoxyethyl)carbamoyl, mono- or bis(2-ethoxyethyl)carbamoyl, mono- or bis(3,6-dioxaheptyl)carbamoyl, mono- or dicyclopentylcarbamoyl, mono- or dicyclohexylcarbamoyl, mono- or dicycloheptylcarbamoyl, phenylcarbamoyl, 2-methylphenylcarbamoyl, 2,4-dimethylphenylcarbamoyl, 2-methoxyphenylcarbamoyl, 2,4-dimethoxyphenylcarbamoyl, 2-chlorophenylcarbamoyl, 2,4-dichlorophenylcarbamoyl, phenyl, 2-, 3- or 4-chlorophenyl, 2-, 3-or 4-methylphenyl, 2,4-dimethylphenyl, 2-, 3- or 4-cyanophenyl, 2-, 3- or 4-methoxyphenyl, 2,4-dimethoxyphenyl or 2-, 3- or 4-nitrophenyl.

Particular preference is given to a process where there is or are located on the transfer one or more dyes of the formula I where B is the radical of an acidic CH compound which is derived from a compound of the formula IIa or IIb.

Particular preference is also given to a process where there is or are located on the transfer one or more dyes of the formula I where K is a radical of the formula IIIa, IIIc, IIIj, IIIk, IIIl or IIIm.

Of particular noteworthiness is a process where there is or are located on the transfer one or more dyes of the formula I where B is the radical of the formula

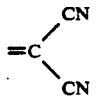

The methine dyes of the formula I can be prepared by methods known per se, as described f or example in JP-A-32 164/1990, earlier application EP-A-416 434 and earlier German Patent Application P 41 05 197.1.

Compared with the dyes used in existing processes, the dyes of the formula I transferred in the process of the present invention are in general notable for improved migration properties in the receiving medium at room temperature, a readier thermal transferability, higher thermal and photochemical stability, readier industrial accessibility, better resistance to moisture and chemicals, higher color strength, better solubility or better suitability for subtractive color mixing (higher cleanness of hue, less blue absorption, better shape of absorption band, e.g. small half-value width or greater flank steepness on the short-wave side). They are also particularly advantageous for use in dye mixtures with red or reddish violet dyes. Such dyes are known for example from EP-A-216 483, EP-A-209 990, EP-A-312 211, U.S. Pat. No. 4,698,651, EP-A-346 729 or earlier applications EP-A-416 434, EP-A-441 208 or EP-A-460 463.

The dyes of the formula I give brilliant magentas when combined with violet dyes and brilliant reddish blues when combined with cyan dyes. Also, combined with suitable yellow dyes, they produce a deep, neutral black.

To prepare the dye transfers required for the process of the present invention, the dyes are incorporated in a suitable organic solvent or in mixtures of solvents with one or more binders, in the presence or absence of assistants, to form a printing ink. It preferably contains the dye in a molecularly dispersed, i.e. dissolved, form. The printing ink can then be applied to the inert substrate of the later transfer with a doctor and air dried.

Suitable organic solvents for the dyes I are for example those in which the solubility of the dyes I at room temperature is greater than 1% by weight, preferably greater than 5% by weight.

Examples are ethanol, propanol, isobutanol, tetrahydrofuran, methylene chloride, methyl ethyl ketone, cyclopentanone, cyclohexanone, toluene, chlorobenzene and mixtures thereof.

As binders it is possible to use any resin or polymer material which is soluble in organic solvents and capable of binding the dye to the inert substrate in such a way that it will not rub off. Preference is here given to those binders which, after the air drying of the printing ink, hold the dye in the form of a clear, transparent film in which no visible crystallization of the dye occurs.

Such binders are mentioned for example in earlier application EP-A-441 282 or in the relevant patent applications cited therein.

Preferred binders are ethylcellulose, ethylhydroxyethylcellulose, polyvinyl butyrate, polyvinyl acetate and saturated linear polyesters.

The weight ratio of binder to dye ranges in general from 1:1 to 5:1.

Suitable assistants are for example release agents as mentioned in earlier application EP-A-441 282 or in the relevant patent applications cited therein. It is also possible to use organic additives which prevent crystallization of the transfer dye in the course of storage or heating of the color ribbon, for example cholesterol or vanillin.

Suitable inert substrates are described for example in earlier application EP-A-441 282 or in the relevant patent applications cited therein. The thickness of the substrate is in general from 3 to 30 μm, preferably from 5 to 10 μm.

As dye receptor layer it is basically possible to use any heat stable plastics layer which possesses affinity for the dyes to be transferred, e.g. modified polycarbonates or polyesters. Further details may be found for example in earlier application EP-A-441 282 or in the relevant patent applications cited therein.

The transfer is effected by means of an energy source, for example by means of a laser or by means of a thermal head that must be heatable to ≧300° C. in order for dye transfer to take place within the time range t: 0<-t<15 msec. In the course of transfer, the dye migrates out of the transfer sheet and diffuses into the surface coating of the receiving medium.

The invention will now be more particularly described in terms of examples, percentages being by weight, unless otherwise stated. Transfer of methine dyes To be able to examine the transfer behavior of the dyes quantitatively and in a simple manner, the thermal transfer was carried out with large hot plates with the transfer temperature being varied within the range 70° C.<T<120° C. while the transfer time was fixed at 2 minutes.

α) General recipe for coating the substrate with dye 1 g of binder was dissolved in 8 ml of 8:2 v/v toluene/ethanol at 40°-50° C. A solution of 0.25 g of dye in 30 ml of tetrahydrofuran was added with stirring and any insolubles were filtered off. The print paste thus obtained was applied to a polyester film (thickness: 6–10 μm) with an 80 μm doctor and dried with a hair dryer.

β) Test of thermal transferability

The dyes used were tested as follows. The polyester film donor containing the in-test dye in the coated front was placed face down on commercially available Hitachi color video print paper (receptor) and pressed down. Donor/receptor were then wrapped in aluminum foil and heated between two hot plates at various temperatures T (within the temperature range 70° C.<-T<120° C.). The amount of dye which diffuses into the bright plastics layer of the receptor is proportional to the optical density (=absorbance A). The latter was determined photometrically. The plot of the logarithm of the absorbance A of the colored receptor papers measured within the temperature range from 40° to 110° C. against the reciprocal of the corresponding absolute temperature is a straight line from whose slope it is possible to calculate the activation energy $\Delta E_T$ for the transfer experiment:

$$\Delta E_T = 2.3 \times R \times \frac{\Delta \log A}{\Delta\left[\frac{1}{T}\right]}$$

The characterization was completed by additionally taking from the plots the temperature T* [° C.] at which the absorbance A of the colored receptor papers attains the value 1.

The dyes listed below in the table were processed according to α) and the resulting dye-coated substrates were tested in respect of their transfer behavior according to β). The table also shows in each case the thermal transfer parameters T* and $\Delta E_T$, the absorption maxima of the dyes $\lambda_{max}$ (measured in methylene chloride) and also the binders used.

The key to the abbreviations is as follows:

B=binder

V=Vylon® 290 from Toyobo

TABLE

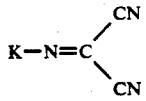

| Ex. No. | K | $R^1$ | $R^2$ | $R^3$ | $R^4$ | B | $\lambda_{max}$ [nm] | R* [°C.] | $\Delta E_T \left[\frac{kcal}{mol}\right]$ |
|---|---|---|---|---|---|---|---|---|---|
| 1 | IIIa | $CH_3$ | H | $C_2H_5$ | $CH_2C_6H_5$ | V | 495 | 76 | 15 |
| 2 | IIIa | $CH_3$ | H | $C_4H_9$ | $C_4H_9$ | V | 503 | 78 | 24 |
| 3 | IIIa | $NHCOCH_3$ | H | $C_2H_5$ | $C_2H_5$ | V | 509 | 73 | 23 |
| 4 | IIIc | $NHCOCH_3$ | — | H | — | V | 505 | 82 | 15 |
| 5 | IIIc | $CH_3$ | — | $C_2H_5$ | — | V | 511 | 84 | 20 |

We claim:

1. A process for transferring a methine dye from a transfer to plastic-coated paper by diffusion, which comprises selecting a transfer on which there is or are located one or more dyes of the formula I

K—N=B (I)

where

K is a radical of the formula (IIIa)

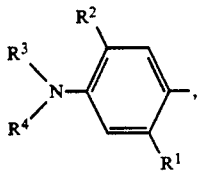

(IIIb)

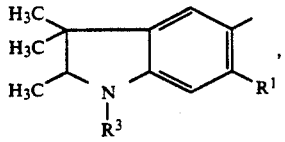

(IIIc)

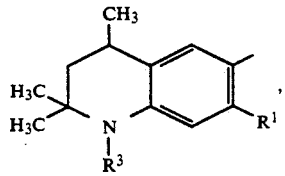

(IIId)

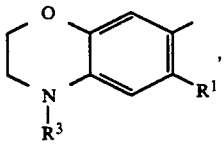

(IIIe)

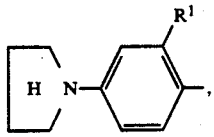

(IIIf)

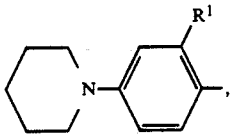

-continued (IIIg)

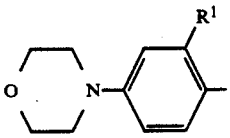

(IIIh)

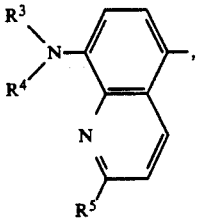

(IIIi)

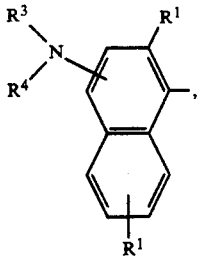

(IIIj)

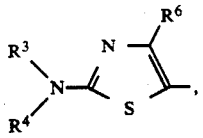

(IIIk)

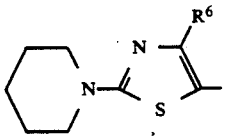

(IIIl)

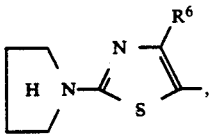

(IIIm)

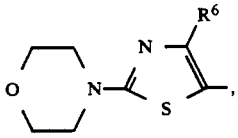

-continued (IIIn)

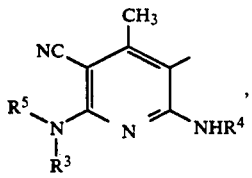

(IIIo)

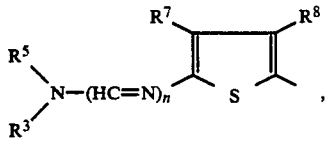

(IIIp)

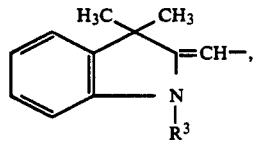

(IIIq)

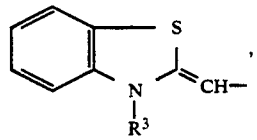

(IIIr)

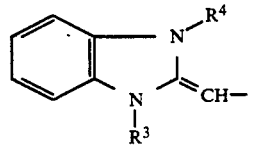

or (IIIs)

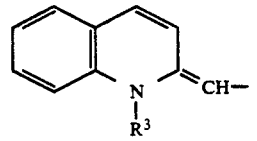

where n is 0 or 1, $R^1$ is hydrogen, methyl, methoxy, mono- or di-$C_1$–$C_4$-alkylaminosulfonylamino, $C_1$–$C_4$-alkylsulfonylamino or the radical —NHCOR$^9$ or —NHCO$_2$R$^9$, where R$^9$ is phenyl, benzyl, tolyl or $C_1$–$C_8$-alkyl which may be interrupted by one or two oxygen atoms in ether function, $R^2$ is hydrogen, methyl, methoxy or ethoxy, $R^3$ and $R^4$ are identical or different and each is independently of the other hydrogen, $C_1$–$C_8$-alkyl, which may be substituted and which may be interrupted by one or two oxygen atoms in ether function, or $C_5$–$C_7$-cycloalkyl, $R^5$ is $C_1$–$C_8$-alkyl, which may be substituted and which may be interrupted by one or two oxygen atoms in ether function, $C_5$–$C_7$-cycloalkyl, phenyl or tolyl, $R^6$ is hydrogen, halogen, $C_1$–$C_6$-alkyl, unsubstituted or $C_1$–$C_4$-alkyl- or $C_1$–$C_4$-alkoxy-substituted phenyl, unsubstituted or $C_1$–$C_4$-alkyl- or $C_1$–$C_4$-alkoxy-substituted benzyl, cyclohexyl, thienyl, hydroxyl or $C_1$–$C_8$-monoalkylamino, $R^7$ is cyano, carbamoyl, mono- or di-$C_1$–$C_6$-alkylcarbamoyl or $C_1$–$C_6$-alkoxycarbonyl, and $R^8$ is halogen, hydrogen, $C_1$–$C_4$-alkyl, $C_1$–$C_4$-alkoxy, $C_1$–$C_4$-alkylthio or unsubstituted or $C_1$–$C_4$-alkyl-substituted phenyl, and B is the radical of an acidic CH compound which is derived from nitromethane, nitroethane, benzimidazol-2-ylacetamide or a compound of the formula (IIa)

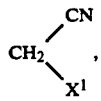

(IIb)

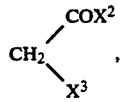

(IIc)

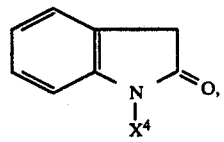

(IId)

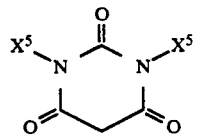

or (IIe)

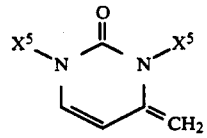

where $X^1$ is cyano, nitro, $C_1$–$C_4$-alkanoyl, unsubstituted or $C_1$–$C_4$-alkyl-, $C_1$–$C_4$-alkoxy- or halogen-substituted benzoyl, $C_1$–$C_4$-alkylsulfonyl, unsubstituted or $C_1$–$C_4$-alkyl-, $C_1$–$C_4$-alkoxy-or halogen-substituted phenylsulfonyl, carboxyl, $C_1$–$C_6$-alkoxycarbonyl, monooxa- or dioxa-$C_1$–$C_6$-alkoxyarbonyl, $C_5$–$C_7$-cycloalkoxycarbonyl, unsubstituted or $C_1$–$C_4$-alkyl-, $C_1$–$C_4$-alkoxy- or halogen-substituted phenoxycarbonyl, carbamoyl, mono- or di-$C_1$–$C_5$-alkylcarbamoyl, monooxa- or dioxa-mono- or -di-$C_1$–$C_6$-alkylcarbamoyl, mono- or di-$C_5$-$C_7$-cyclo-alkylcarbamoyl, unsubstituted or $C_1$-$C_4$-alkyl-, $C_1$–$C_4$-alkoxy- or halogen-substituted phenylcarbamoyl, unsubstituted or $C_1$–$C_4$-alkyl-, cyano-, $C_1$–$C_4$-alkoxy-, halogen- or nitro-substituted phenyl, 2-benzothiazolyl, 2-benzimidazolyl, 5-phenyl-1,3,4-thiadiazol-2-yl or 2-hydroxyquinoxalin-3-yl, $X^2$ is $C_1$–$C_4$-alkyl or $C_1$–$C_4$-alkoxy, $X^3$ is $C_1$–$C_4$-alkoxycarbonyl, phenylcarbamoyl or 2-benzimidazolyl, $X^4$ is $C_1$–$C_4$-alkyl, and $X^5$ is hydrogen, $C_1$–$C_4$-alkyl or phenyl with the proviso that when K is a radical of formula IIIa, IIIc or IIIi, $X^1$ is not unsubstituted or $C_1$–$C_4$-alkyl-, $C_1$–$C_4$-alkoxy-or halogen-substituted benzoyl, and heating the transfer to induce dye transfer to plastic-coated paper.

2. A process as claimed in claim 1, wherein there is or are located on the transfer one or more dyes of the formula I where B is the radical of an acidic CH compound which is derived from a compound of the formula IIa or IIb.

3. A process as claimed in claim 1, wherein there is or are located on the transfer one or more dyes of the formula I where K is a radical of the formula IIIa, IIIc, IIIj, IIIk, IIIl or IIIm.

4. A process as claimed in claim 3, wherein K is a radical of the formula IIIa in which $R^1$ is $CH_3$, $R_2$ is H, $R^3$ is $C_2H_5$ and $R^4$ is $CH_2C_6H_5$ and B is of formula $C(CH)_2$.

* * * * *